US005984556A

United States Patent [19]

Gray et al.

[11] Patent Number: 5,984,556

[45] **Date of Patent: *Nov. 16, 1999**

[54] WRITING INSTRUMENT IMPROVED OUTER BARREL AND METHOD OF PRODUCING THE OUTER BARREL

[75] Inventors: Curtis Gray, Stratford; Michael J. McKenna, Shelton; Christine Weigand, Milford, all of Conn.

[73] Assignee: BIC Corporation, Milford, Conn.

[ * ] Notice: This patent is subject to a terminal disclaimer.

[21] Appl. No.: 08/778,810

[22] Filed: Jan. 3, 1997

[51] Int. Cl.[6] ..... B43K 7/00

[52] U.S. Cl. ..... 401/192; 401/88; 401/96

[58] Field of Search ..... D19/47, 49, 50; 401/96, 192, 88

[56] References Cited

U.S. PATENT DOCUMENTS

| | | | |
|---|---|---|---|
| D. 31,072 | 6/1899 | Tucker . | |
| D. 42,553 | 5/1912 | Tolfree . | |
| D. 143,053 | 11/1945 | Waldinger | D19/50 |
| D. 161,310 | 12/1950 | Brown | D19/50 |
| D. 170,539 | 10/1953 | Lovejoy | D19/50 |
| D. 229,357 | 11/1973 | Defores | D19/50 |
| D. 231,408 | 4/1974 | Jenkins . | |
| D. 231,409 | 4/1974 | Jenkins . | |
| 337,307 | 3/1886 | Cotter . | |
| D. 359,307 | 6/1995 | Anavil et al. | D19/50 |
| 659,026 | 10/1900 | Goldsmith . | |
| 1,989,351 | 1/1935 | Crowell | 401/192 |
| 3,551,064 | 12/1970 | Bartner | 401/96 |
| 5,281,039 | 1/1994 | Hsiung et al. | 401/195 |
| 5,360,281 | 11/1994 | Kamen et al. | 401/96 |

FOREIGN PATENT DOCUMENTS

| | | | |
|---|---|---|---|
| 1234577 | 2/1967 | Germany | 401/192 |
| 497169 | 12/1938 | United Kingdom | 401/192 |
| 883917 | 5/1960 | United Kingdom | 401/192 |

*Primary Examiner*—Steven A. Bratlie
*Attorney, Agent, or Firm*—Abelman, Frayne & Schwab

[57] ABSTRACT

A writing instrument is disclosed which includes a cartridge having a writing tip portion and a unique barrel having a generally elongated tubular configuration and an outer surface portion having a plurality of spiral shaped surface irregularities in the form of surface grooves which enhance the gripping of the barrel by the user. The barrel also includes a multisided inner opening which, combined with the outer grooved surface, provides a unique array of light transmission and diffusion which distorts the appearance of the cartridge and the barrel thus causing the barrel to have a translucent character. A method of producing barrel stock from which the barrels may be cut is also disclosed.

21 Claims, 3 Drawing Sheets

WRITING INSTRUMENT IMPROVED OUTER BARREL AND METHOD OF PRODUCING THE OUTER BARREL

BACKGROUND

1. Technical Field

The present invention relates to writing instruments, and more particularly, to writing instruments having a barrel having an improved gripping surface and a unique appearance due to a unique combination of barrel surfaces resulting in transmission, reflection and diffusion of light with respect to the barrel.

2. Background of Related Art

Writing instruments generally include a barrel which is held in the hand of the user, for writing, and having a writing tip which communicates with a source of ink. Often the barrels are molded of a synthetic plastic material and have a smooth finish on the outer surface which in many instances, inhibits the user's ability to grip the barrel to write effectively. Also, in the case of "STIC" pens, the plastic material is translucent and in many cases transparent, thus permitting viewing of an ink cartridge positioned inside the barrel.

More recently attempts have been made to enhance the grip of writing instruments by providing rubber-like covering material on the barrel surface. In addition, in some instances, even separate attachment devices have been made and marketed to be attached to a standard writing instrument to improve the writer's grip on the instrument. Such modifications generally add to the production costs.

Accordingly, the need exists to improve the gripping surfaces of writing instruments while improving the appearance, without necessarily providing an additional cover for the outer barrel. In particular, the need for such improvement of the gripping surface is desirable while at the same time maintaining the appearance of the writing instrument or alternatively, while improving the appearance. The present invention relates to a writing instrument which includes a unique outer barrel which has an improved gripping surface while having an enhanced physical appearance due to the unique structural characteristics of the barrel. In particular, such improved appearance is caused by the transmission, reflection and diffusion of light with respect to the barrel which is extruded of a transparent plastic material in any one of a variety of selected colors to provide an unusually active rotating barber pole effect when the barrel is rotated. Due to the physical characteristics of the barrel, it essentially becomes translucent to light. The present invention also relates to the method of producing the improved outer barrel.

SUMMARY

A writing instrument is disclosed which comprises a writing tip portion and a unique outer barrel having a generally elongated tubular configuration and an outer surface portion. The outer surface portion of the barrel has a plurality of spiral shaped surface irregularities to enhance gripping of the barrel by the user. The outer barrel is generally tubular shaped and has an inner opening having a multisided cross-sectional shape. Each corner of the multisided inner opening of the outer barrel has a spiral shape similar and corresponding to the spiral shaped surface discontinuities on the outer surface, whereby light transmitted into and reflected from the barrel causes the cartridge to appear to have a twisted configuration as viewed from outside the barrel. In the embodiment disclosed, the spiral shaped discontinuities are grooves in the outer surface of the barrel.

In the preferred embodiment, the barrel is extruded from cellulose propionate. Other synthetic plastic materials such as cellulose acetate, cellulose butyrate, polystyrene, polycarbonate, acrylic, polypropylene or the like may be utilized. The outer surface of the barrel is generally circular, and the inner opening has a generally octagonal cross-section. Preferably, the generally octagonal inner opening of the barrel is comprised of eight generally flat surfaces extending along a generally spiral path along the length of the barrel. In the absence of the specific physical characteristics of the barrel as disclosed herein, the barrel would normally be fully transparent and would therefore transmit light without appreciable scattering. However, due to the particular physical characteristics disclosed, the barrel assumes a translucent character, and therefore transmits light with some diffusion such that objects are not seen identically or clearly through the barrel.

A method is also disclosed for producing a stock material for writing instrument barrels which comprises introducing an extrudable material, such as cellulose propionate into a heater, heating the material until it is sufficiently molten for extruding purposes, introducing the molten extrudable material into a die having a generally circular cross-sectional shape and having a mandrel positioned centrally thereof, the mandrel having a multisided cross-sectional shape, rotating the mandrel at a rotational speed within the die as the extruding material passes therethrough, and cooling the molten material until it is solidified into a barrel stock having a plurality of spiral shaped surface discontinuities extending along the length of the outer surface and a multisided spiral shaped inner opening corresponding in cross-section to the cross-sectional shape of the mandrel. The mandrel has an eight sided cross-sectional shape. Lastly, a length of the barrel stock is cut to provide a barrel for a writing instrument.

The rate of rotation of the mandrel is generally dependent upon the desired configuration of the spiral shaped surface discontinuities, taking into consideration the linear speed of the extrusion.

BRIEF DESCRIPTION OF THE DRAWINGS

Preferred embodiments of the subject writing instrument are described hereinbelow with reference to the drawings wherein.

DETAILED DESCRIPTION OF PREFERRED EMBODIMENTS

Figure 1:
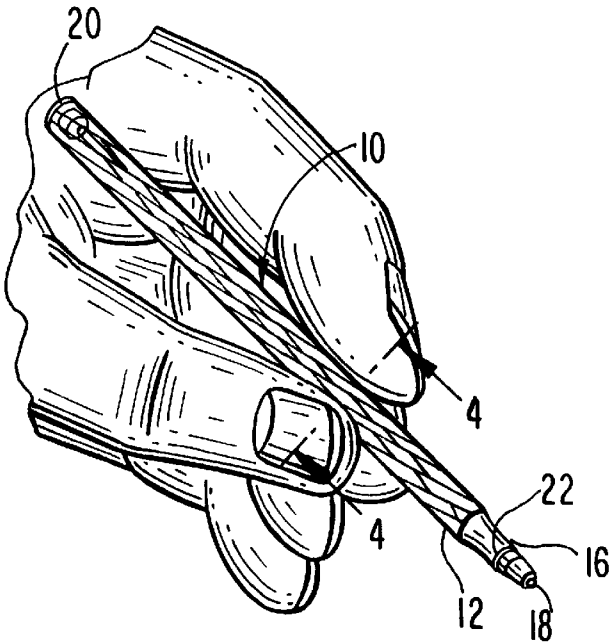
FIG. 1 is a perspective view of a writing instrument constructed according to the invention illustrating the improved outer barrel having an improved outer gripping surface.

Referring initially to FIG. 1, there is illustrated a perspective view of the writing instrument 10 of the present invention, showing the outer barrel having an improved outer gripping surface having a plurality of spiral shaped discontinuities in the form of small grooves thereon. As can be seen in the drawings, the writing instrument includes outer barrel 12 in which writing cartridge 14 is supported for containing a suitable writing medium such as a solvent based or water based ink. Writing tip support portion 16 supports writing tip 18 which communicates with the ink contained in cartridge 14 for writing purposes on a suitable medium such as writing paper. The outer barrel 12 also supports a suitable end plug 20 which prevents excess ventilation within the barrel 12 to reduce the tendency of the ink supply to dry. However, appropriate air venting is provided by a small space or groove 22 provided between the writing tip support portion 16 and the cartridge. Alternatively, a small venting aperture may be provided in the outer barrel 12.

Figure 2:
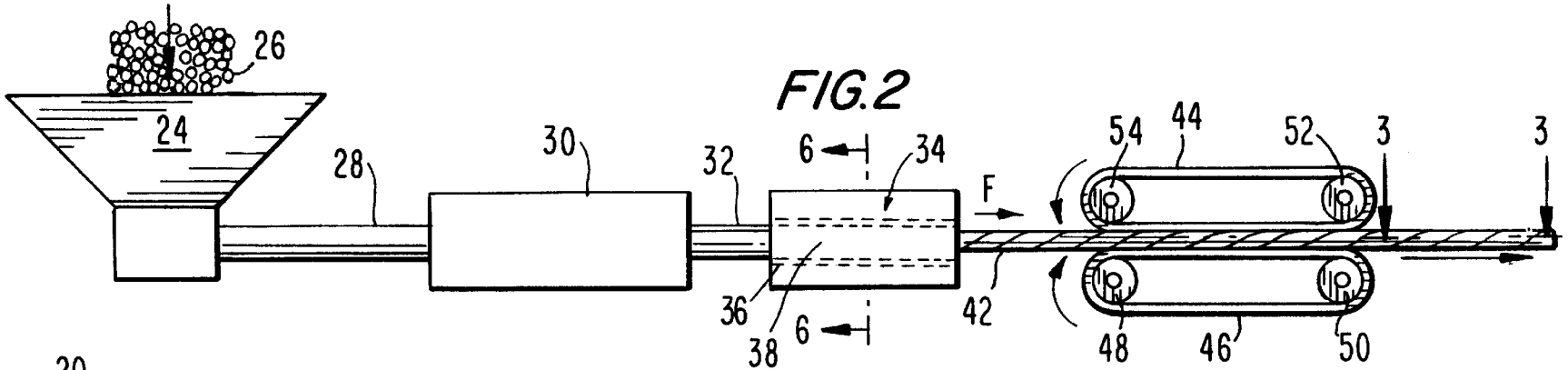
FIG. 2 is a schematic representation of the steps for producing the outer barrel of the writing instrument shown in FIG. 1.
Figure 3:
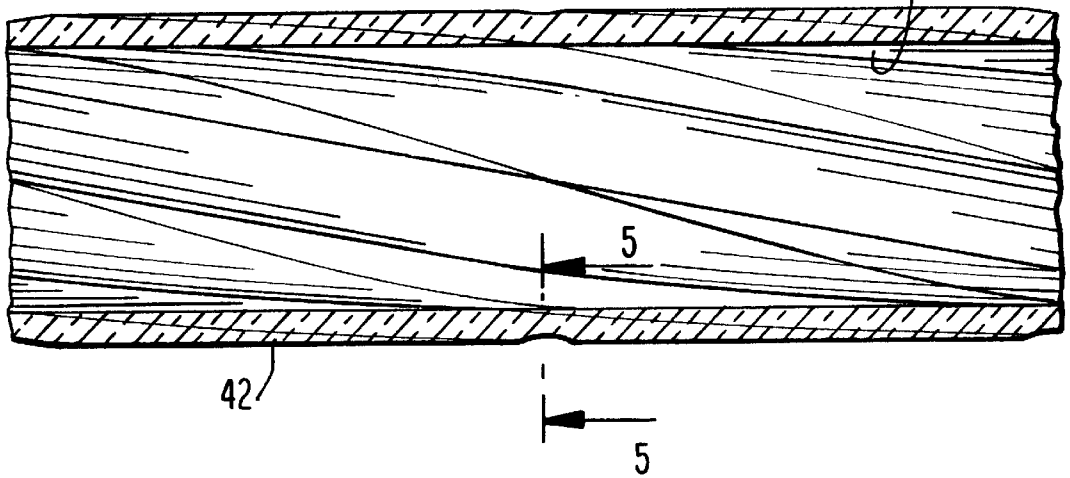
FIG. 3 is a cross-sectional view taken along lines 3—3 of FIG. 2, of a portion of the tubular shaped stock material from which the outer barrel of the writing instrument is cut.

Referring now to FIG. 2, the method of extruding the improved outer barrel 12 is illustrated in schematic format. Hopper 24 is provided for the reception of a suitable resin 26 which is utilized to produce the barrel stock from which the pen barrels are cut. Any number of suitable extrudable materials may be utilized, with the preferred material being cellulose propionate. Alternative materials include cellulose acetate, cellulose butyrate, polystyrene, polycarbonate, acrylic, polypropylene, etc.. The resin 26 is transferred via conduit 28 to a heater 30 wherein it is heated to a suitable temperature to cause it to become sufficiently molten for extruding purposes. Thereafter, the material is transferred via conduit 32 to die unit 34 wherein it is continuously extruded into pen barrel stock 42 having a polygonal inner opening 37.

Figure 6:
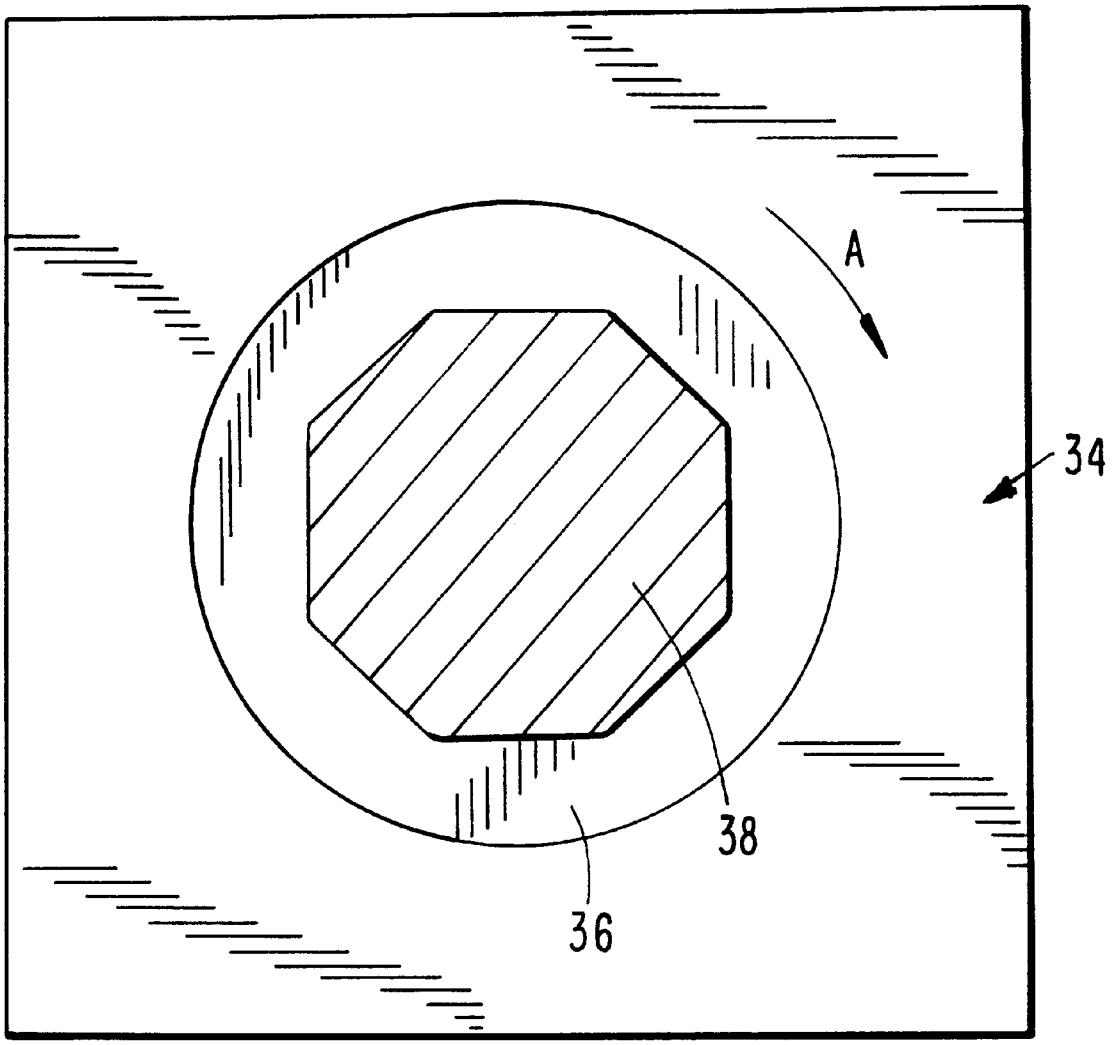
FIG. 6 is a view taken along lines 6—6 showing a cross-section of the outer die and the multisided mandrel positioned therein for extruding the outer barrel of the writing instrument according to the invention.

The extrusion process is accomplished by introducing the molten material into an outer die 36 which is positioned within the die unit 34 and has a generally tubular circular cross-section. An inner mandrel 38 having an octagonal cross-section is positioned centrally of the circular die 36 and is continuously rotated as the material is introduced into the die. While in the die, the molten material is partially cooled and is thereby permitted generally to assume the outer circular shape of the opening of the outer die 36 while the mandrel 38 is rotated at a predetermined rate as indicated by arrow "A" in FIG. 6. As the molten material passes through die 36, it is permitted to begin the cooling process such that when it exits die unit 34, it will have assumed the basic circular outer shape of die 36 and will have an assumed eight sided inner opening 40 similar in shape to mandrel 38, but of a spiral configuration.

The partially solidified extruded barrel stock material 42 exits the die under the influence of force "F" provided by rotating conveyor belts 44, 46 which are operated by motor driven rotating drive pulley-type wheels 48, 50, 52, 54. The barrel stock material 42 is then transported away from belts 44, 46 to undergo further cooling. Thereafter, the barrel stock is then cut to appropriate lengths for utilization on the writing instruments such as shown in FIG. 1.

Figure 4:
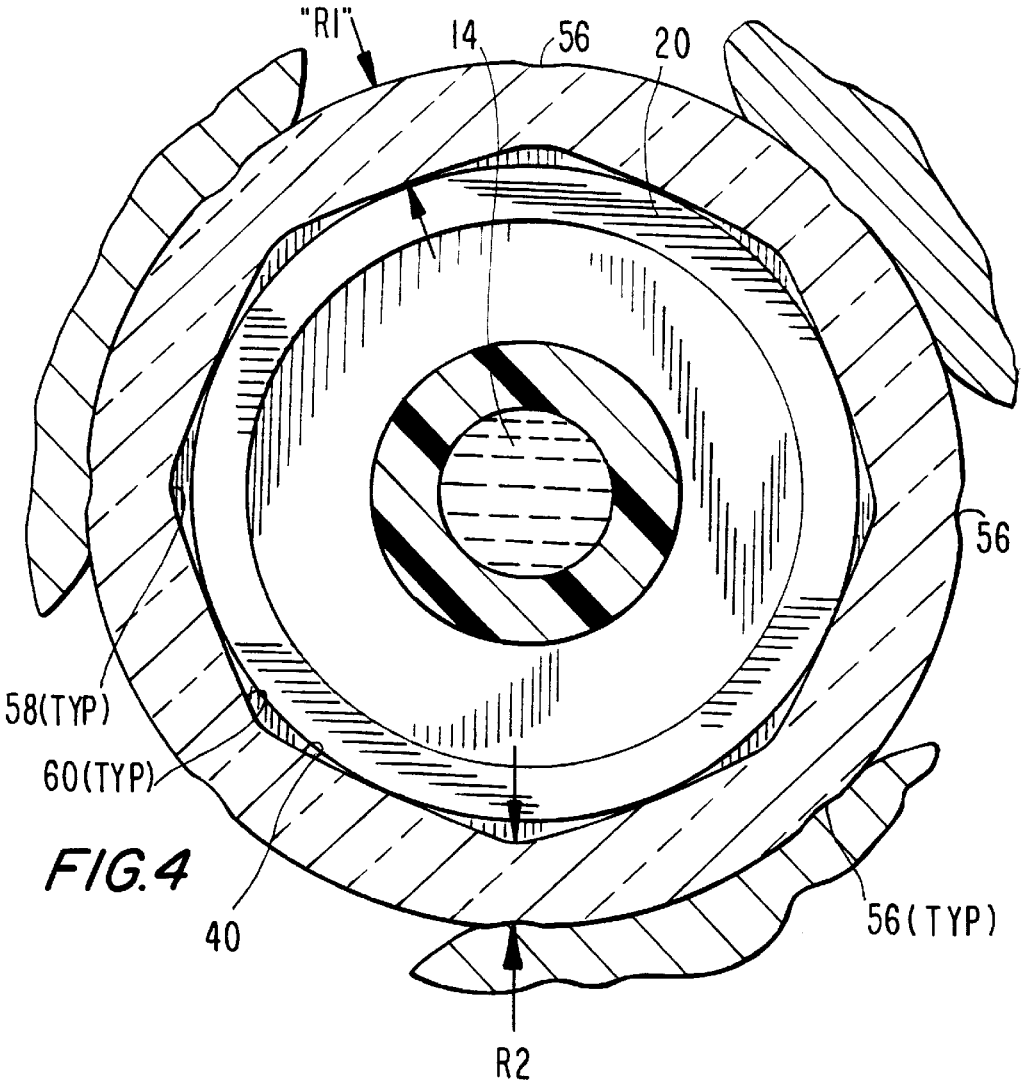
FIG. 4 is a cross-sectional view taken along lines 4—4 of FIG. 1.
Figure 5:
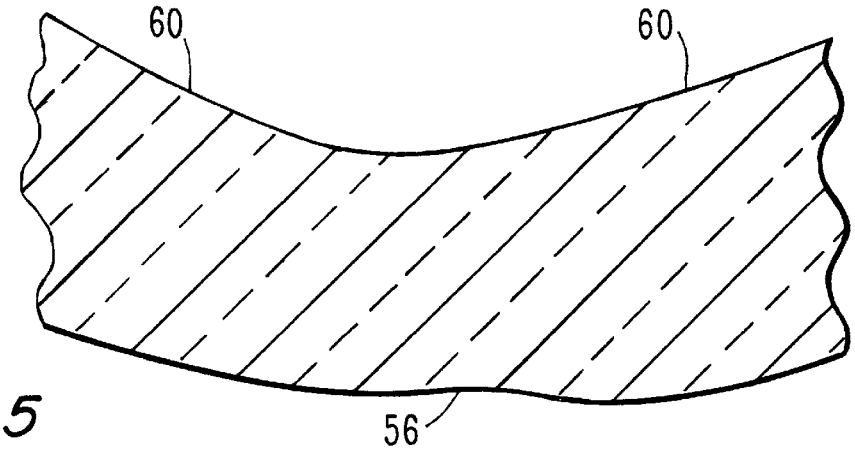
FIG. 5 is a greatly enlarged cross-sectional view taken along lines 5—5 of FIG. 3, illustrating the opposed representative surface discontinuities which enhance gripping of the writing instrument.

It has been found that due to a combination of unique contributing factors the cooling process of the barrel stock causes distinct rates of shrinkage of the barrel stock material with the result that the outer surface of the barrel stock 42 assumes a plurality of spiral shaped surface discontinuities in the form of small grooves 56 extending along the length of the stock and having a spiral-like shape. In a similar fashion, the inner surface of the inner opening 40 assumes an eight sided cross-sectional shape similar to that of the octagonal shaped mandrel, with the result that the respective corners 58 of the inner opening assume a spiral-like shape similar to the shape of small grooves 56, and the inner flat surfaces 60 assume a spiral-like shape along the length of the barrel stock. Thus, each inner corner 58 of the inner opening is directly behind each corresponding surface groove 56 as shown in FIGS. 4 and 5. It is believed that since the radial dimension "R1" located midway between adjacent inner corners 58 is greater than the radial dimension "R2" located between each inner corner 58 and the corresponding outer surface of the stock material, the cooling and resultant shrinkage rates differ between these locations thereby causing the creation of the unique small spiral shaped grooves 56 on the outer surface. Simultaneously, the correspondingly unique spiral shaped flat surfaces 60 which form the inner octagonal opening are formed. Pen barrels 12 of predetermined length are then cut from the barrel stock 36.

The pen barrel can be extruded of different colors. As noted above, normally, the material is transparent and would transmit light without appreciable scattering so that bodies lying beyond are entirely visible and clear. However, due to the unique surfaces and grooves on the barrel, the barrel assumes a translucent character and light is transmitted by the barrel and particularly reflected and diffused, with the result that the outer and inner surfaces of the barrel and the cartridge positioned therewithin have a somewhat distorted appearance. One effect of such distortion is that when the barrel is rotated in the hand, a unique effect of linear and rotational motion is provided, with one result being that the inner cartridge appears to rotate in barber pole fashion, while having a twisted and fractured appearance. The resultant pen barrel 12 provides this unique effect due to the combination of the spiral shaped discontinuities in the form of grooves 56 on the outer surface of the barrel and the inner flat surfaces 60 which form the inner octagonal opening 40 of the barrel and extend along a spiral path along the length.

Thus, in addition to the unique light reflectance and diffusion which provides such unusual array of light scattering, it has been found that the spiral shaped surface discontinuities—or grooves 56—on the outer surface of the writing instrument enhance the gripping capability of the instrument by reducing the tendency of the user's fingers to slip in a longitudinal direction while gripping the pen to apply downward or other forces on the instrument during use for writing. This gripping enhancement is due to the unique spiral shape of the grooves 56. However, because of the relatively small depth of these grooves, they are barely visible to the naked eye, yet they nevertheless are of sufficient depth to be felt by the user and to effect the improved gripping and the light transmission and scattering as described above.

Although the stock material is preferably extruded using an octagonal shaped mandrel as described, it is within the scope of the invention to select the appropriate material or to use a mandrel of any other selected number of sides to produce the desired distinctive effects on the barrel. For example, an extruding mandrel of 6 or 4 sides can be used with differing, yet comparable and effective results. However, as indicated, an eight sided mandrel is preferred.

What is claimed is:

1. A writing instrument which comprises a writing tip portion and an outer barrel made of a light transmitting material and having a generally elongated tubular configuration and an outer surface portion, said outer surface portion having a plurality of spiral shaped surface irregularities to enhance gripping of the barrel by the user, said outer barrel having an inner opening formed of a plurality of adjacent spiral shaped generally flat surfaces corresponding in shape to said spiral shaped surface irregularities on said outer surface portion such that said inner opening has a multisided cross-sectional shape, whereby light transmitted into said outer barrel and reflected therefrom provides an appearance of surface distortions.

2. A writing instrument, which comprises:

a) a cartridge containing a writing substance; and b) a writing tip portion in communication with said writing substance for contacting a surface material for writing thereon; and c) a generally tubular shaped outer barrel supporting said cartridge and said writing tip portion, said outer barrel being made of a light transmitting material and having an outer surface having a plurality of spiral shaped surface discontinuities to enhance gripping, and an inner opening being fanned of a plurality of adjacent spiral shaped generally flat surfaces corresponding in shape to said spiral shaped discontinuities on said outer surface such that said inner opening has a multisided cross-sectional shape, whereby light transmitted into said outer barrel and reflected therefrom causes said cartridge to appear to have a twisted configuration as viewed from outside said outer barrel.

3. The writing instrument according to claim 2 wherein each corner of said multisided inner opening of said outer barrel has a spiral shape which generally corresponds to said spiral shaped surface discontinuities in said outer surface.

4. The writing instrument according to claim 3 wherein said spiral shaped discontinuities are grooves in the outer surface of said outer barrel.

5. The writing instrument according to claim 4 wherein said barrel is extruded from a synthetic plastic material.

6. The writing instrument according to claim 5 wherein said plastic material is transparent.

7. The writing instrument according to claim 6 wherein said plastic material is cellulose propionate.

8. The writing instrument according to claim 7 wherein said outer surface of said barrel has a generally circular cross-section.

9. The writing instrument according to claim 8 wherein said inner opening of said outer barrel has a generally octagonal cross-section.

10. The writing instrument according to claim 9 wherein said generally octagonal inner opening of said outer barrel is comprised of eight generally flat surfaces extending along a generally spiral path along the length of said outer barrel.

11. The writing instrument according to claim 6 wherein said plastic material is at least one of cellulose acetate, cellulose butyrate, polystyrene, polycarbonate, acrylic and polypropylene.

12. A method of producing a stock material for writing instrument barrels which comprises:

a) introducing an extrudable material into a heater;

b) heating said extrudable material until it is a molten extrudable material;

c) introducing said molten extrudable material into a die having a generally circular cross-sectional shape and having a mandrel positioned centrally thereof, said mandrel having a cross-sectional outer shape having a plurality of adjacent generally flat surfaces;

d) rotating said mandrel at a rotational speed within said die as said molten extrudable material passes therethrough; and e) cooling said molten extrudable material until it is solidified into a barrel stock having a plurality of spiral shaped surface discontinuities extending along the length of the outer surface and a multisided spiral shaped inner opening having a plurality of adjacent generally flat spiral shaped surfaces corresponding in cross-section to the cross-sectional shape of said mandrel.

13. The method according to claim 12 wherein said mandrel has an eight sided cross-sectional shape.

14. The method according to claim 13 wherein said material is cellulose propionate.

15. The method according to claim 14 further comprising adding a coloring agent to said cellulose propionate.

16. The method according to claim 15 further comprising cutting a predetermined length of said barrel stock to provide a barrel for a writing instrument.

17. The method according to claim 12 wherein said extrudable material is at least one of cellulose acetate, cellulose butyrate, polystyrene, polycarbonate, acrylic and polypropylene.

18. A barrel for a writing instrument, which comprises a generally tubular shaped member made of a light transmitting material and having an outer surface portion, said outer surface portion having a plurality of spiral shaped grooves to enhance gripping of the barrel by the user, said tubular shaped member having an inner opening formed of a plurality of adjacent spiral shaped generally flat surfaces corresponding in shape to said spiral shaped grooves on said outer surface portion such that said inner opening has a multisided cross-sectional shape, whereby light transmitted into said generally tubular shaped member and reflected therefrom provides an appearance of surface distortions.

19. The barrel according to claim 18 wherein said generally tubular shaped member is extruded from an extrudable plastic material.

20. The barrel according to claim 19 wherein said extrudable plastic material is cellulose propionate.

21. The barrel according to claim 19 wherein said extrudable material is at least one of cellulose acetate, cellulose butyrate, polystyrene, polycarbonate, acrylic and polypropylene.

* * * * *